United States Patent [19]

Payne

[11] Patent Number: 4,483,028

[45] Date of Patent: Nov. 20, 1984

[54] BABY SAFETY BARRIER

[76] Inventor: Shirley S. Payne, 1318 Turtle Creek, Manchester, Mo. 63011

[21] Appl. No.: 477,507

[22] Filed: Mar. 21, 1983

[51] Int. Cl.[3] ..... A47C 21/08

[52] U.S. Cl. ..... 5/426; 5/430; 16/266

[58] Field of Search ..... 16/266, 307, 351, 353, 16/355, 342, 387; 5/426, 428, 430

[56] References Cited

U.S. PATENT DOCUMENTS 1,022,174 4/1912 Boness ..... 16/387

3,874,029 4/1975 McCullough ..... 16/329

4,233,699 11/1980 Amato ..... 5/426

*Primary Examiner*—Andrew V. Kundrat

*Attorney, Agent, or Firm*—Polster, Polster and Lucchesi

[57] ABSTRACT

A baby safety barrier has an upright panel, a platform panel and one or more hinges connecting the panels along adjacent edges thereof, the hinges having leaves mounted to rotate between a position at which they are substantially parallel to and overlying one another and a position at which they are substantially perpendicular to one another, and a locking device for releasably retaining the leaves and panels in the perpendicular position.

5 Claims, 7 Drawing Figures

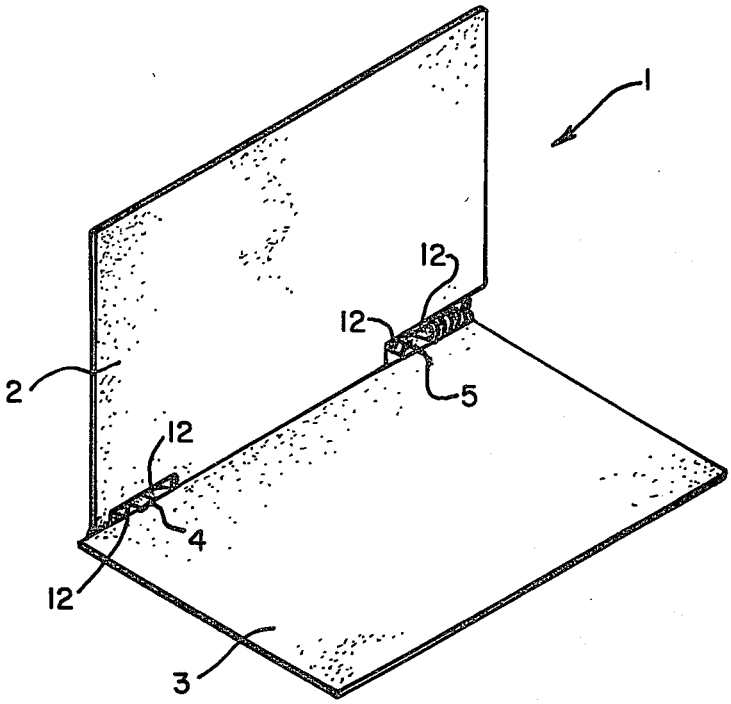
FIG. 1.
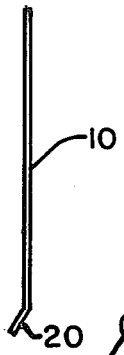
FIG. 2.
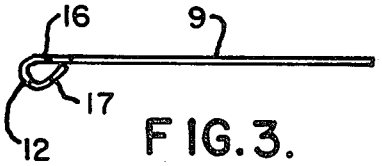
FIG. 3.
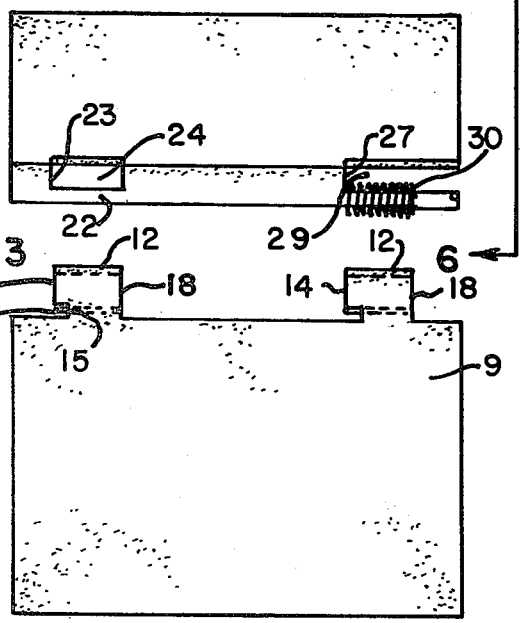
FIG. 4.
FIG. 5.
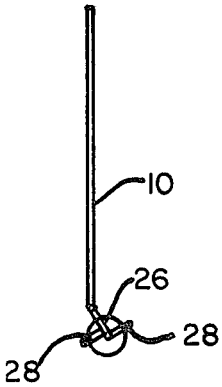
FIG. 6.
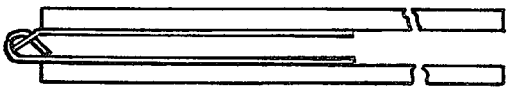
FIG. 7.

BABY SAFETY BARRIER

BACKGROUND OF THE INVENTION

It is common knowledge that small babies, for example those under six months old, can and do wriggle from one position to another while they are being ministered to. Frequently, a lone person trying to feed or change a baby has to leave the child momentarily, to reach for a piece of clothing or a feeding bottle or the like. During that time, a baby can fall off an elevated surface. Devices to be used as safety barriers have been sold commercially, but they have had certain disadvantages. One type has legs, pivoted at the lower ends of a rack-like fence, for movement from a position parallel to the fence under the fence, where the legs face one another, to a position at right angles to the fence. The legs in the latter position can be put under a mattress or sofa cushion if the latter is wide enough, to hold the fence in position to serve as a barrier to the baby's falling off. Such a device has the virtue of holding the fence perpendicular to the legs, but it has the disadvantage not only of requiring some sort of hold-down but of requiring a relatively long span of cushion or other hold-down member, and unless the legs are to overlap one another, which is bulky, their length is limited to half the length of the fence.

One of the objects of this invention is to provide a baby safety barrier that is simple, economical, safe, portable, compact and effective, that can be used without a hold-down if desired, although some such member is preferred, and can be used with a hold-down of any length.

Other objects will become apparent to those skilled in the art in the light of the following description and accompanying drawing.

Summary of the Invention

In accordance with this invention, generally stated, a baby safety barrier is provided with an upright panel, a platform panel and hinge means for connecting the two panels along adjacent edges thereof, the hinge means having leaves mounted to rotate between a position at which they are substantially parallel to and overlying one another and a postion at which they are perpendicular to one another, and means for releasably retaining the leaves in the perpendicular position. Preferably, the hinge means includes pintles and knuckles shiftable laterally with respect to one another to engage in locking condition at one shifted position and to disengage from locking condition at another shifted position selectively to lock the leaves perpendicular to one another, and means for biasing the leaves toward the locking position. In the preferred embodiment described, the leaves are also selectively locked in their parallel position.

BRIEF DESCRIPTION OF THE DRAWINGS

In the drawing, FIG. 1 is a view in perspective of one illustrative embodiment of baby safety barrier of this invention;

FIG. 2 is a view in edge elevation of one leaf of a hinge of the device of FIG. 1, with an integral pintle;

FIG. 3 is a view in edge elevation taken along the line 3—3 of FIG. 5 of another leaf of the hinge, with an integral knuckle;

FIG. 4 is a view in front elevation of the leaf shown in FIG. 2;

FIG. 5 is a view in plan of the leaf shown in FIG. 3;

FIG. 6 is a view in edge elevation taken along the line 6—6 of FIG. 4; and FIG. 7 is a view in edge elevation of the device in folded condition.

DESCRIPTION OF THE PREFERRED EMBODIMENT

Referring now to the drawing for one illustrative embodiment of the baby safety barrier of this invention, reference numeral 1 indicates the assembled device, in its operating condition, with an upright panel 2 and a platform panel 3, connected by hinges 4 and 5. The hinge 5 is spring loaded, as is described below.

Each of the hinges 4 and 5 has a platform leaf 9, and an upright leaf 10. In the embodiment shown, the platform leaf of each hinge has two, spaced knuckles 12 along and integral with one edge, rolled as shown in FIG. 3. The knuckles have two notches in one edge, an upright position notch 16 shown in FIGS. 3 and 5 and an overlying position notch 17, shown in FIG. 3. The upright leaf 10 has a bent margin 20 along one edge, in which pintles 22 and 26 are formed integrally. The pintles 22 and 26 are rotatably and slidably mounted within the knuckles 12 when the hinge is made. The pintle 22 defines one edge of a closed slot 24, of which a locking shoulder 23 forms a side perpendicular to the pintle 22. The pintle 26 defines one edge of a slot 29 open at its end adjacent an edge of the upright panel 2. The other end of the slot 29 is defined by a locking shoulder 27. In this embodiment, a compression spring 30 is mounted on the pintle 26, compressed between a pair of retaining fingers 28 integral with and bent out from the pintle 26, and an uninterrupted edge 18 of a knuckle 12. The compression of the spring 30, biases the leaf 10, hence the panel 2, in the direction toward the notches 16 and 17, i.e., from left to right as viewed in FIG. 1.

Preferably, the leaves 9 and 10 are secured to the panels 3 and 2, respectively, on the outside of the panels as viewed in FIG. 1. In the position of the panels shown in FIG. 1, the locking shoulders 23 and 27 are seated in the notches 16, which locks the panels in position. In order to fold the panels to the condition shown in FIG. 7, the panel 2 must be moved to the left as viewed in FIG. 1 with respect to the panel 3, against the bias of the spring, to move the locking shoulders 23 and 27 out of the seats formed by the notches 16, and the panels rotated through 270° with respect to one another to the position shown in FIG. 7, where the bias of the spring will cause the locking shoulders 23 and 27 to snap into the seats formed by the notches 17, to lock the panels into folded, overlying position. The steps are reversed to erect the panel 2 with respect to the panel 3. It can be seen that in the embodiment shown, the panel 3 can be used as the upright, and the panel 2 as the platform.

As is evident, the platform panel can be used to put a baby on, when its weight will tend to hold the panel in place. However, preferably, the platform panel is put beneath an additional hold-down, such as a cushion, pillow or mattress. Because the platform panel is continuous, the length of the hold-down is largely immaterial to the operation of the device.

The device of this invention can be stored easily, carried in a bag, or provided with hand-holds near the outer edges, or with straps.

Numerous variations in the construction of the device of this invention within the scope of the appended claims will occur to those skilled in the art in the light of the foregoing disclosure. The leaves of the device described are preferably adhered as by epoxy or the like to a panel of hardboard or the like, but they can be equipped with the usual fastenerreceiving holes and secured by screws or rivets. The hinges can be made integral with panels made of a suitable plastic or a light metal, for example, or can be made separately of some different material, such as metal when the panels are plastic, and molded into the panels. In that case, the panels themselves will constitute the hinge leaves as well as the panels. Hinge 4 can be made with two pintles like pintle 22, because it does not have to accommodate a spring. Other biasing means can be provided, different from the compression spring 30, such as a tension spring or a leaf spring, and the biasing means can be mounted on the panels rather than on the pintles. The hinges can be made continuous along the edges of the panels, like modified piano hinges, or a multiplicity of discrete hinges can be provided. Other locking means may be employed, or none at all, if the hinge is made with a stop to prevent its moving from the upright postion in the direction away from the platform panel, although the preferred form, with a positive locking arrangement, offers many advantages. These variations are merely illustrative.

I claim:

1. A baby safety barrier comprising an upright panel, a platform panel and hinge means connecting said panels along adjacent edges thereof, said hinge means being mounted to rotate said panels between a position at which they are substantially parallel to and overlying one another and a position at which they are perpendicular to one another, said hinge means including interlocked pintles and knuckles secured along said panel edges and shiftable laterally with respect at one pivoted position to further one another to engage in locking condition at one shifted position and to disengage from locking condition at another oppositely shifted position selectively to lock said panels in a position substantially perpendicular or parallel to one another at selected pivotal positions.

2. The device of claim 1 wherein said pintles and knuckles are selectively lockable in a position substantially parallel to one another.

3. The device of claim 1 including biasing means continuously biasing the said pintles and knuckles toward the shifted position at which they are locked.

4. The device of claim 2 including biasing means continuously biasing the said pintles and knuckles toward the shifted position at which they are locked.

5. The device of claim 3 wherein the biasing means is a spring mounted on a pintle and bearing on a side of a knuckle.

* * * * *